US005421798A

United States Patent [19]

Bond et al.

[11] Patent Number: 5,421,798

[45] Date of Patent: Jun. 6, 1995

[54] CLOSED CHAIN EVALUATION AND EXERCISE SYSTEM

[75] Inventors: Malcolm L. Bond, Winters; Gary Engle, Fair Oaks, both of Calif.

[73] Assignee: Cedaron Medical, Inc., Davis, Calif.

[21] Appl. No.: 62,285

[22] Filed: May 17, 1993

[51] Int. Cl.[6] ..... A63B 21/005

[52] U.S. Cl. ..... 601/23; 601/33; 482/1; 482/3; 482/901

[58] Field of Search ..... 482/1-9, 482/901-903; 128/25 B, 25 R; 601/23, 24, 26, 27, 33

[56] References Cited

U.S. PATENT DOCUMENTS

| | | | |
|---|---|---|---|
| 4,889,108 | 12/1989 | Bond et al. | 482/901 X |
| 4,934,694 | 6/1990 | McIntosh | 482/901 X |
| 5,050,618 | 9/1991 | Larsen | 128/774 |
| 5,211,161 | 5/1993 | Stef | 128/25 B |

*Primary Examiner*—Richard J. Apley
*Assistant Examiner*—Glenn E. Richman
*Attorney, Agent, or Firm*—Fliesler, Dubb, Meyer & Lovejoy

[57] ABSTRACT

An apparatus for evaluation of a limb of a test subject. The apparatus generally includes a pedal or grip to secure the distal end of the limb to the apparatus and a seat to secure the proximal end of the limb to the apparatus. A motor and transmission assembly is coupled to the pedal or grip to provide a controlled load to the distal end of the limb. The apparatus also includes a measurement and control system to determine the load to be applied, and to measure and compute the force on each joint of the limb while the controlled load is applied to the limb. The measurement and control system includes a force sensor, coupled to the pedal, the force sensor being capable of resolving force in at least two directions; a position sensor, coupled to the pedal; and a computer with control software, coupled to the force sensor and the motor, the computer including means for controlling the force exerted on the pedal or grip by the limb of the test subject and the force exerted on the pedal or grip by the motor and transmission.

18 Claims, 12 Drawing Sheets

CLOSED CHAIN EVALUATION AND EXERCISE SYSTEM

CROSS-REFERENCE TO RELATED APPLICATION(S)

U.S. patent application Ser. No. 07/789,834, entitled PHYSIOLOGICAL EVALUATION AND EXERCISE SYSTEM, filed Nov. 8, 1991, inventors Malcolm L. Bond, Gary Engle, Joseph Forma and Theodore F. Neumann. This application is hereby specifically incorporated by reference.

BACKGROUND OF THE INVENTION

1. Field of the Invention

The invention relates to the training, evaluation, and retraining of factors that limit human performance. Specifically, the invention relates to a method and apparatus for training, evaluating and reconditioning the performance of the arm, shoulder, and legs.

2. Description of the Related Art

Rehabilitation specialists are often asked to conduct an assessment of patients that have acquired a limitation to their optimal independent activity. Reconditioning or retraining of functional human performance is also an important goal of rehabilitation.

Although the parameters of human performance vary widely, one may identify several principles which are common to all forms of independent activity. Such common principles are muscular strength, endurance, joint range of motion, and motor coordination. It is these parameters of performance that the rehabilitation specialist will focus upon. The specialist directs attention upon the identified parameter's which are limiting performance and evaluates the degree of the limitation.

In the process of reconditioning, each of these principles will also be the focus of attention. Each of them will be enhanced by retraining therapy. The underlying physiological adaptations responsible for performance enhancement include, but are not limited to, vascularity, cell biochemistry and motor coordination skills.

The methods used in both the assessment and retraining process of the muscle groups are closely related. Both procedures physically tax or overload the affected muscle group to quantify its performance and also to cause biological adaptations to improve the performance of that muscle group. Historically, the rehabilitation specialist will have a hands on approach using his own healthy limb to resist the movement of the patient's limb. In this way, the clinician evaluates the patient's performance through feel and, at the same time, offers exercise to the limited muscle group. By repetitive, hands on, accommodating exercise, the limited muscle group is overloaded and adapts biologically with improved performance.

For example, muscle strength is a performance parameter which is quite plastic in quickly adapting to immobilization or disuse as well as to increased activity or overuse. That is, muscle strength quite quickly increases or decreases with respect to use or disuse. Disuse, such as immobilization following injury or casting after surgery, results in a significant decrement in muscle size and hence muscle strength. In contrast, if free weight lifting is used as the method of choice for the rehabilitation therapy, the end result is a quick response of increased muscle cell size and hence gains in muscle strength.

Weight lifting equipment will overload a muscle group by using gravity against which a muscle must move the weight. With free weights, no controls are present to direct the speed of movement of the limb nor the resistance throughout the range of motion that the muscle must work against. The maximum free weight resistive load that can be applied to a limb is determined by the capacity of the associated muscle group as measured throughout the range of motion of the limb. The maximum load that the limb can support varies throughout its range of motion where at some point it is at a minimum and at another it is at a maximum. Hence, the maximum resistive free weight load that can be applied is equal to the maximum supportable load in the weakest area of the range of motion.

Conventional methods of subjective assessment and reconditioning, such as subjective "through the clinician's hands" evaluations and free weight exercise, are now reinforced with technology.

Technology has been developed which provides for assessment and reconditioning of muscular deficiencies by electronic control of the rate of movement of the limb. This rate of movement control is achieved by constantly varying the amount of resistance offered the moving limb throughout the range of motion. This category of devices are to allow the muscle group, usually a whole limb or limb segment, to accelerate to a pre-selected speed. These constant speed devices use the methods of isokinetic or accommodating resistance.

In the isokinetic system, once the moving limb achieves the selected speed, the device then offers the muscle group an accommodating resistance which is proportional to the contractile force such that the limb continues to move at the selected speed. These mechanisms usually have some form of position/time feed back, servo loop which directs the resistance, for example, through feeding a variable current to a DC servo motor, to be such that, no matter what constantly varying force is executed by the contracting muscle group, the limb does not exceed or fall below the speed selected.

The goal with isokinetic systems is that throughout the entire range of motion of the limb, the associated muscle groups are working at their utmost level while receiving an optimal overloading resistance.

The contractile effort of a muscle group against this type of microprocessor based resistance is registered by the system and produces a profile of contractile performance which is widely recognized as accurate and repeatable. The data from such a system can be used in a court of law as evidence in disability claims.

Examples of such isokinetic systems are the Cybex, manufactured by Lumex, U.S. Pat. No. 3,465,592, inventor J. Perrine; the LIDO manufactured by Loredan, U.S. Pat. No. 4,601,468; inventor M. Bond, KIN COM manufactured by Chattanooga, U.S. Pat. No. 4,711,450, inventor J. McArther; the Biodex, U.S. Pat. No. 4,628,910, inventor R. Krukowski and U.S. Pat. No. 4,691,694, inventor R. Boyd, et al.; and the devices disclosed in U.S. Pat. Nos. 3,848,467 and 4,235,437. Each of these systems use the method of isokinetic resistive exercise/assessment applied to the large muscle groups of the legs particularly the knee. Attachments are also available to modify some of these devices to address the arms and, secondarily, the ankle, wrist and hand.

These systems represent an application of the "open chain" concept of evaluation and training. That is, the particular joint or muscle group under test is isolated and subjected to testing, evaluation and/or training while the balance of the limb or body is restrained in a fixed position. Recent studies have indicated that such systems are not as accurate a reflection of the work patterns of the muscular system as originally thought {CITE?}. A preferred system of limb training and evaluation involves allowing the entire limb to move throughout its normal functional course, thereby integrating the action of all muscular groups involved in the moving the limb in a more realistic manner. Such a system provides a more accurate representation of the status of the particular muscle group or joint range under test.

To date, no such "closed chain" systems are available which provide adaptability to different limbs and incorporate the ability to analyze the forces present on individual muscle groups or joints of a particular limb, and the ability to utilize various resistance modes for testing and training.

For example, a system known as the Kinetron, manufactured by Cybex Corporation, [address], is a passive, hydraulic based closed chain system. The system utilizes a full weight bearing approach wherein the hydraulic resistance responds to the full weight of the test subject, supported by the subject's leg. The Kinetron does not provide various resistance modes and, in particular, lacks the ability to discern the forces present on individual muscle groups or joints during the test exercise.

Another example of the currently available closed chain system is the Nova MLE, manufactured by Nova Biodesign, Inc., and disclosed in U.S. Pat. No. 4,679,786. In this system, a user can exercise by engaging four slides, one for each limb. The slides travel along parallel paths, enabling reciprocating motion, although the slides are not required to function in reciprocating fashion. Each slide connects to a chain or cable segment, to enable reciprocating cable motion, which connect to gears, causing reciprocation of clutches, thereby impulsing a fly wheel in a single direction and causing rotation. Ostensibly, the system includes an electromagnetic brake which provides programmable loads from 5–100 lbs, with resistance controlled to match the strength curves of the user. Although the NOVA MLE may be preset with exercise programs tailored to the individual, the system does not provide complete analysis of the loads present on the individual joint systems of the limb under test. Neither does the apparatus provide various testing modes, such as isokinetic, isotonic or isometric resistance testing for the particular limbs under test.

SUMMARY OF THE INVENTION

Thus, an object of the invention is to provide a closed chain limb evaluation and testing apparatus.

A further object of the invention is to provide a closed chain exercise apparatus providing the clinician with control over various exercise modes.

A further object of the invention is to provide an evaluation system which determines the load relative to each joint in the system.

These and other objects of the invention are provided in a closed chain apparatus for evaluation of a limb of a test subject. The apparatus generally includes a pedal or grip to secure the distal end of the limb to the apparatus and a seat to secure the proximal end of the limb to the apparatus. A motor and transmission assembly is coupled to the pedal or grip to provide a controlled load to the distal end of the limb. The apparatus also includes a measurement and control system to determine the load to be applied, and to measure and compute the force on each joint of the limb while the controlled load is applied to the limb.

In one embodiment the motor and transmission can apply both concentric or eccentric force to the pedal or grip. In a further embodiment, at least two pedals and/or grips may be provided so that both arms and/or legs may be subject to test simultaneously.

The pedals or grips may be positioned adjacent the seat and arranged for linear movement with respect to the seat. In general, the measurement and control system includes a force sensor, coupled to the pedal, the force sensor being capable of resolving force in at least two directions; a position sensor, coupled to the pedal; and a computer with control software, coupled to the force sensor and the motor, the computer including means for controlling the force exerted on the pedal or grip by the limb of the test subject and the force exerted on the pedal or grip by the motor and transmission.

BRIEF DESCRIPTION OF THE DRAWINGS

The invention will be described with respect to the particular embodiments thereof. Other objects, features, and advantages of the invention will become apparent with reference to the specification and drawings in which.

DESCRIPTION OF THE PREFERRED EMBODIMENT

The evaluation and training apparatus 20 of the present invention may be utilized to analyze the movement, strength and endurance of the limbs of the human body. In the embodiment shown in FIG. 1, apparatus 20 is configured to measure the motion of one or both human legs, alone or simultaneously. It should be readily understood after review of the specification that apparatus 20 may be configured to be used with human arms by use of attachments to replace the foot attachments hereinafter described, or, with minor modifications, to include the capability to measure both arms and legs simultaneously.

Apparatus 20 includes a control means, generally comprising a personal computer and software, which enables the apparatus to perform various programmable functions based on user specific measurement data, provided by either the user and/or a clinician, and performance data provided by the electromechanical elements of the device. A unique feature of apparatus 20 is that the measurement and training of the limb or limbs under test occurs in a closed chain fashion; that is, the natural movement of the leg is measured as a whole, and forces and loads on each joint are computed. A closed chain analysis provides a more realistic evaluation of the loads present on each joint under test as such loads are determined in the context of the joint as used with all muscular groups of the limb.

Apparatus 20 has various operational modes, including isokinetic (linear and angular), isotonic, isometric, isoacceleration, and programmable force and velocity as a function of the position of the limb. These control modes are more specifically defined as follows: isokinetic (linear)—pedal speed is controlled to a constant speed independent of the force applied by the limb; isokinetic (angular)—pedal speed is regulated so that the angular velocity of a selected joint is constant; isotonic—pedal speed is allowed to accelerate as the user applied force is increased; isometric—the device is held stationary independent on the force applied, up to the machines maximum capability or the programmed maximum force, while the force applied by the limb is measured; isoacceleration—pedal velocity is increased at a programmable rate as force is exerted upon it; and variable velocity or force as a function of position—programmable force or velocity profiles may be applied as a function of limb positions. Acceleration/deceleration profiles are maintained out of and into stops. Further, in isokinetic (angular) mode, for angular velocity to remain constant, as the pedal moves away from the body, linear velocity decreases. In such mode, either the knee, or the hip may be used as a controlling joint with the forces on all joints being computed.

Figure 1:
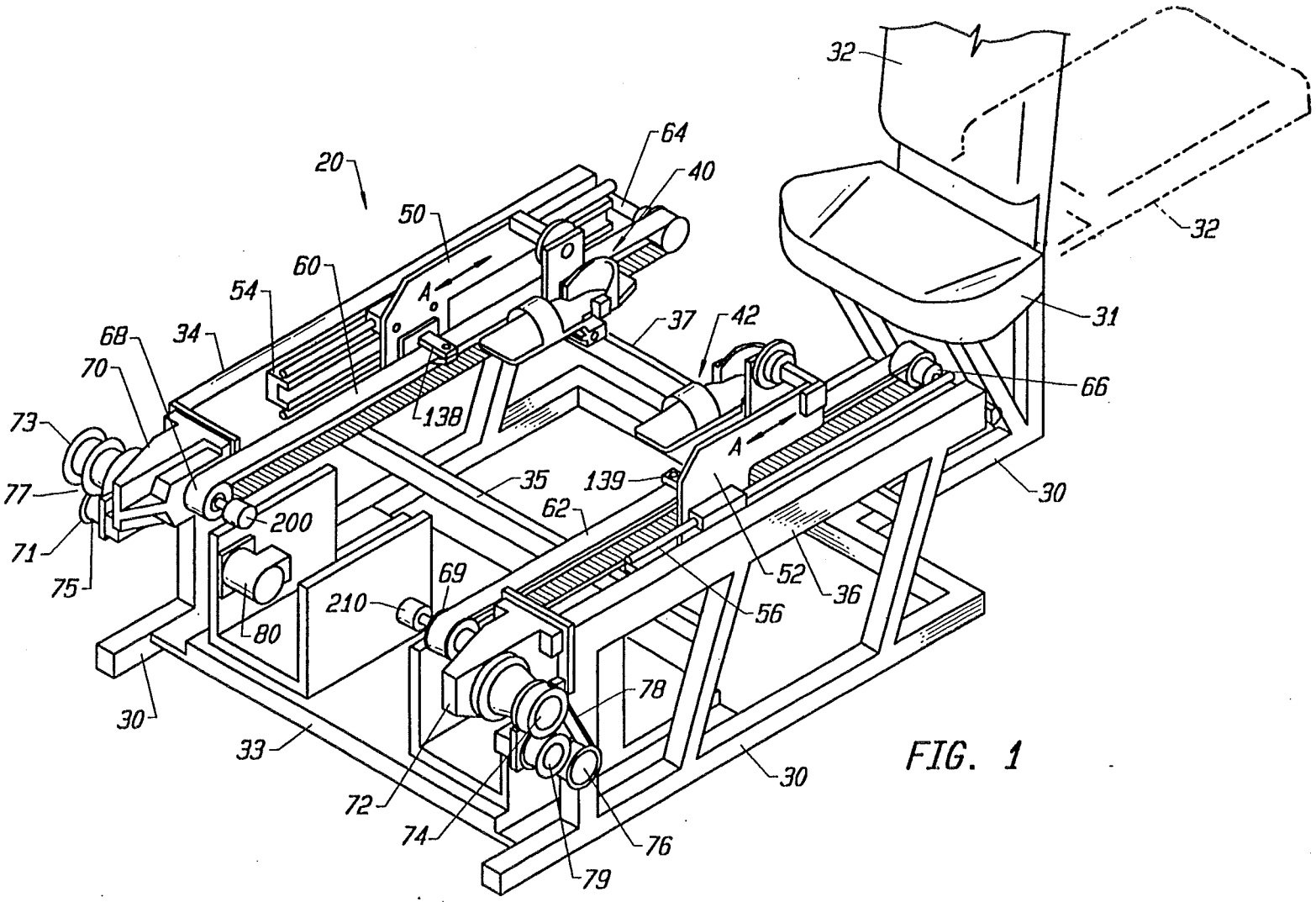
FIG. 1 is a perspective view of the evaluation and exercise system of the present invention.
Figure 2:
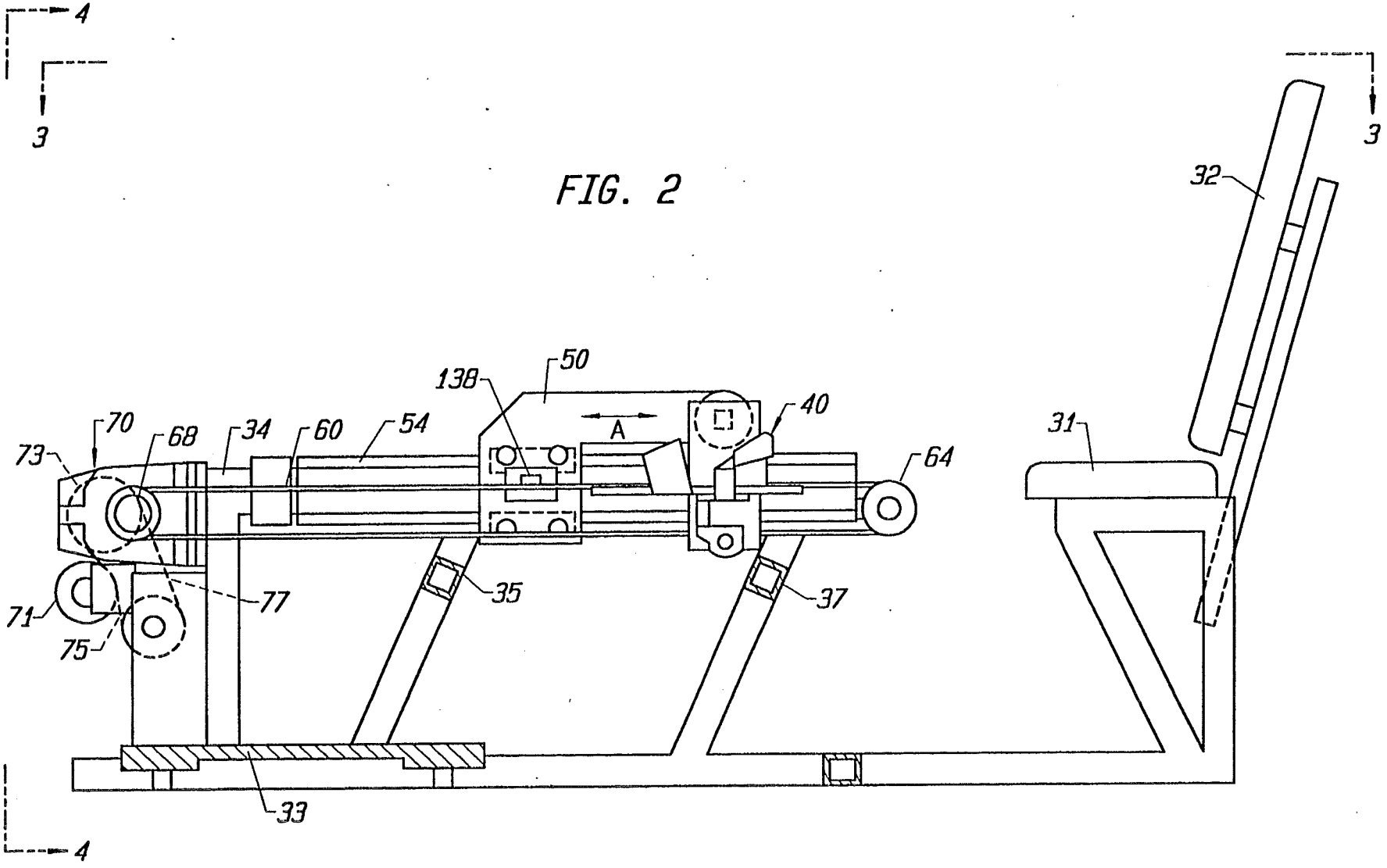
FIG. 2 is a side cutaway view of the evaluation and exercise system of the present invention.
Figure 3:
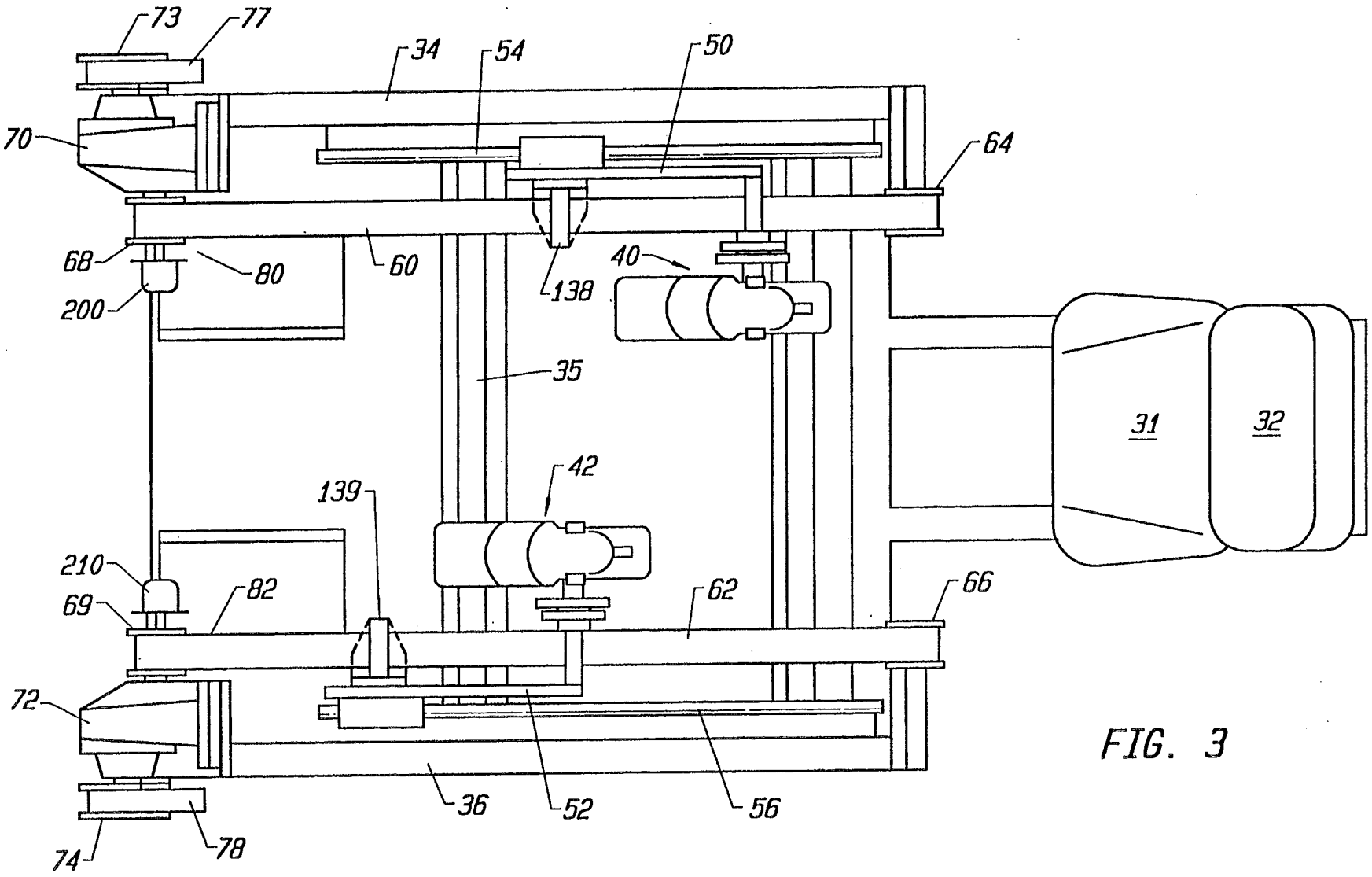
FIG. 3 is a top view along line 3—3 in FIG. 2 of the evaluation and exercise system.
Figure 4:
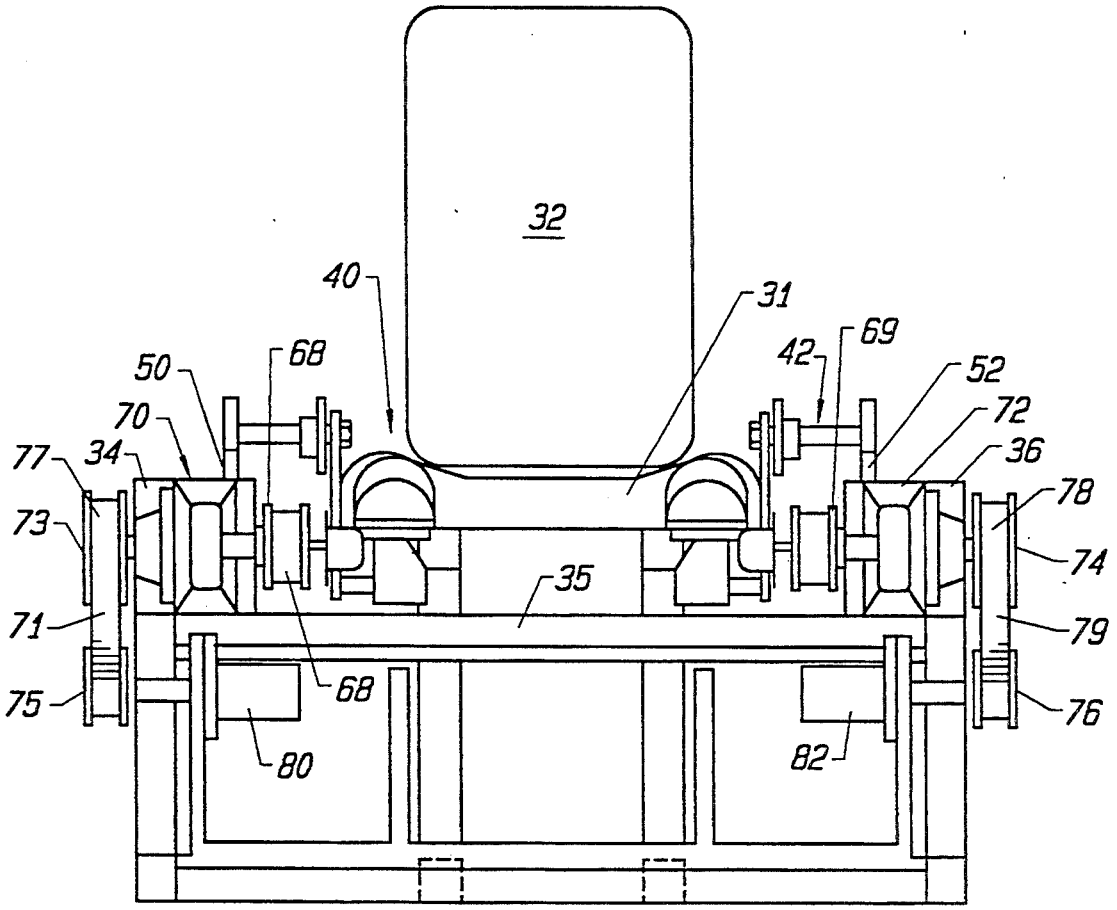
FIG. 4 is a front view along line 4—4 in FIG. 2 of the evaluation and exercise system.
Figure 7:
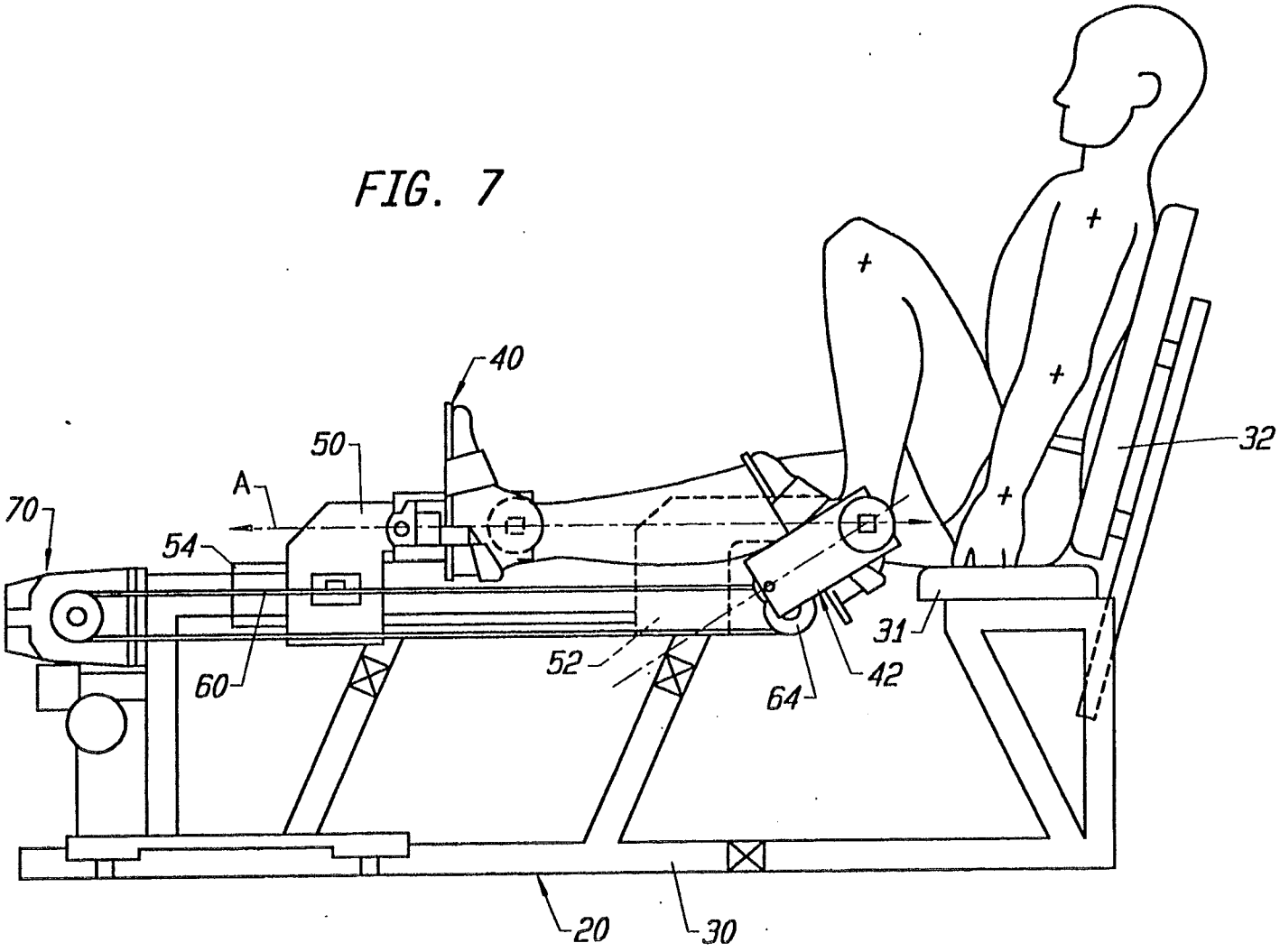
FIG. 7 is a side view illustrating one use of the evaluation exercise system of the present invention.
Figure 8:
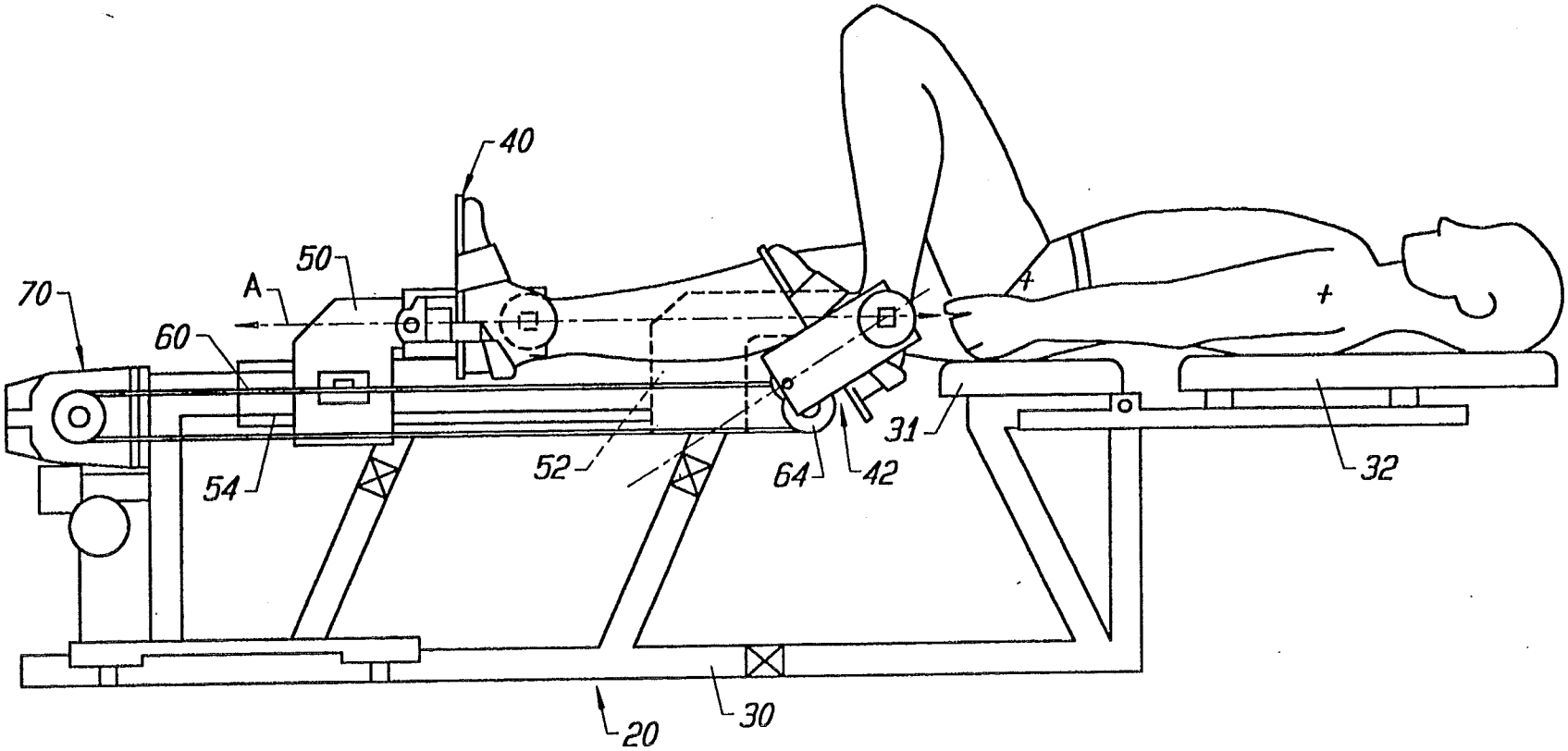
FIG. 8 is a side view of the exercise system of the present invention illustrating a second manner of use of the system.

The embodiment of apparatus 20 shown in FIG. 1 is configured for measuring forces on the joints and segments during movement of the human legs. Apparatus 20 is supported by a frame 30 which includes a base portion 33, side beams 34,36 and cross beams 35,37. Frame 30 also supports a seat 31 including seat back 32 which may be reclined, as shown in FIG. 1. Two pedal assemblies 40,42 are positioned within reach of seat 31 and are used to secure a test subject's feet while the subject is seated in seat 32 for testing (FIGS. 7 and 8). Seat 31 may be adjusted to position a test subject seated therein closer to or further from pedal assemblies 40,42, to accommodate various sizes of individuals. A passive restraint belt (not shown) may also be included to secure a test subject in seat 31 during testing.

Each pedal assembly 40,42 is mounted to a sled 50,52. Sleds 50,52 are, in turn, mounted to double-sided guide tracks 54,56 which are secured to beams 34,36, respectively, of frame 30. Details of pedal assemblies 40,42 will be discussed below with respect to FIG. 5.

Figure 5:
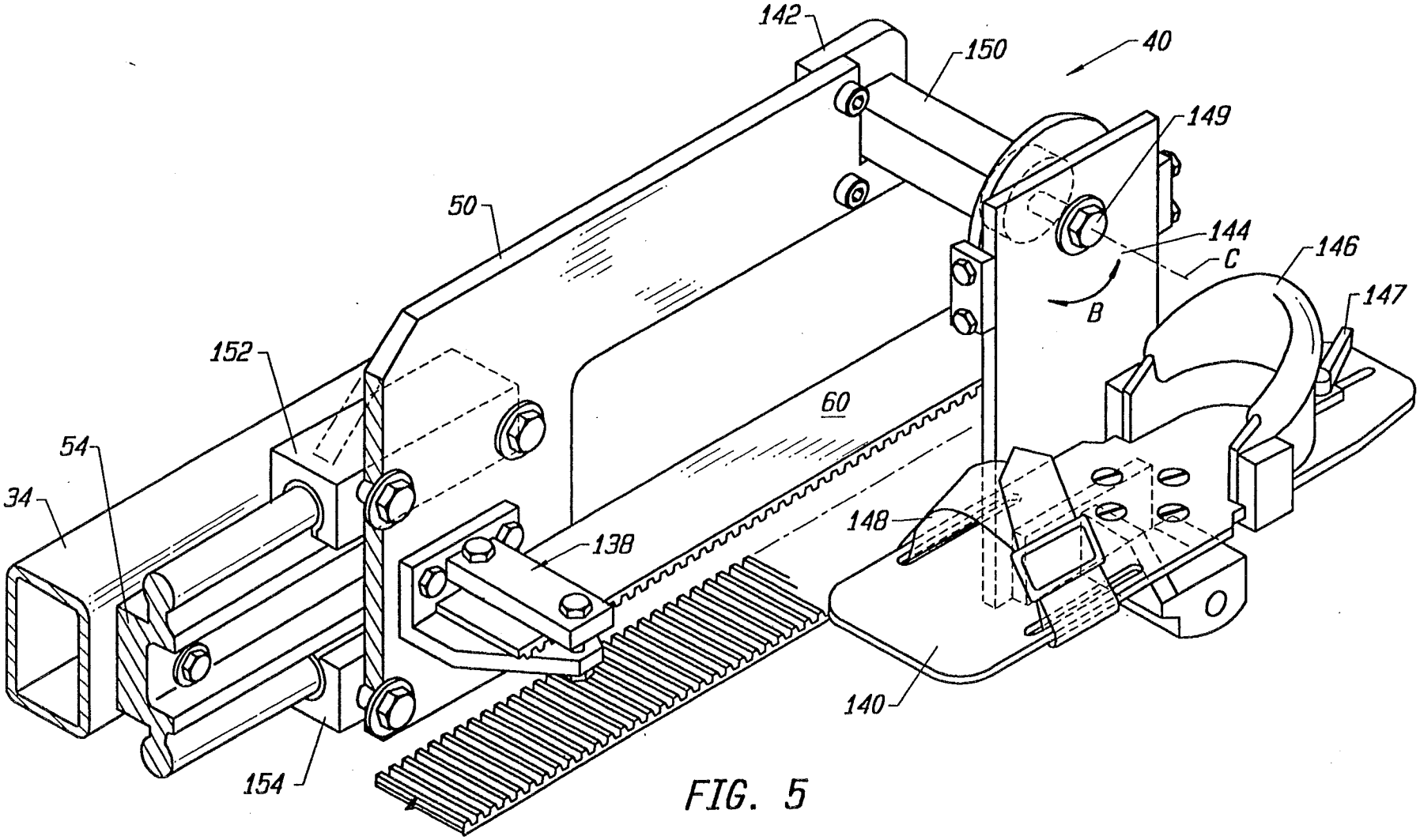
FIG. 5 is a partial, perspective view of a peddle assembly for use in accordance with the evaluation and exercise system of the present invention.

Sleds 50,52 are movable along guide tracks 54,56, respectively, along the direction of arrow "A" shown in FIG. 1. Each sled 50,52 is coupled to a belt, 60,62, respectively, which translates pedal motion to positioning sensors, comprised of optical encoders, and provides resistance to pedal assemblies 40,42 under the direction of the control system. Each belt 60,62 wraps around a rear pulley 64,66, and a front pulley 68,69, respectively. Rear pulleys 64,66 are free to rotate and are designed to provide a negligible resistance with respect to the force of a patient's movement. Belts 60,62 may be endless loop belts, or, as shown in FIG. 1 and FIG. 5, may comprise tooth belts coupled to sleds 50,52 by mounting brackets 138,139, respectively. Front pulleys 68,69, are coupled to transmission assemblies 70,72, respectively. Two servo motors 80,82 provide resistance load and force to pedal assemblies 40,42 via transmission assemblies 70,72. Servo motors 80,82 are coupled to transmissions 70,72 by belts 77,78, wrapped around pulley 75,76 and directly to the output shaft of each servo motor 80,82, respectively, which translate force of the motor to pulley 73,74, respectively. Each transmission assembly is comprised of stepdown gearing which translates the rotational forces provided by servo motors 80,82 to pedal assemblies 40,42, respectively. Two tension pulleys 71,79, are provided to ensure sufficient tension on belts 77,78, respectively. Servo motors 80,82 may comprise dc servo motors such as Model M4090B, manufactured by Infranor, Inc. Also as shown in FIG. 1, optical encoders 200,210 are utilized to provide position data on the pedals in relationship to the frame to the control system.

Transmission assemblies 70,72 translate the speed of the servo motors 80,82 to the usable values required at the pedal assemblies 40,42 while maintaining high torque. A reducing ratio of 10 to 1 is generally required. A gear assembly such as Boston Gear USA, Inc., Model 321, are suitable for this purpose.

Thus, apparatus 20 provides at least four various potential modes of operation: concentric, where the pedal assemblies are allowed to move in the direction the user moves his or her limb; eccentric, where the pedal assemblies move opposite to the user action; a combination of concentric and eccentric; and continuous passive motion (CPM), where the system moves with or without user action.

The above-mentioned mechanical configuration allows the apparatus 20 to provide an eccentric force up to 150 lbs., and a concentric force up to 350 lbs.

Figure 6:
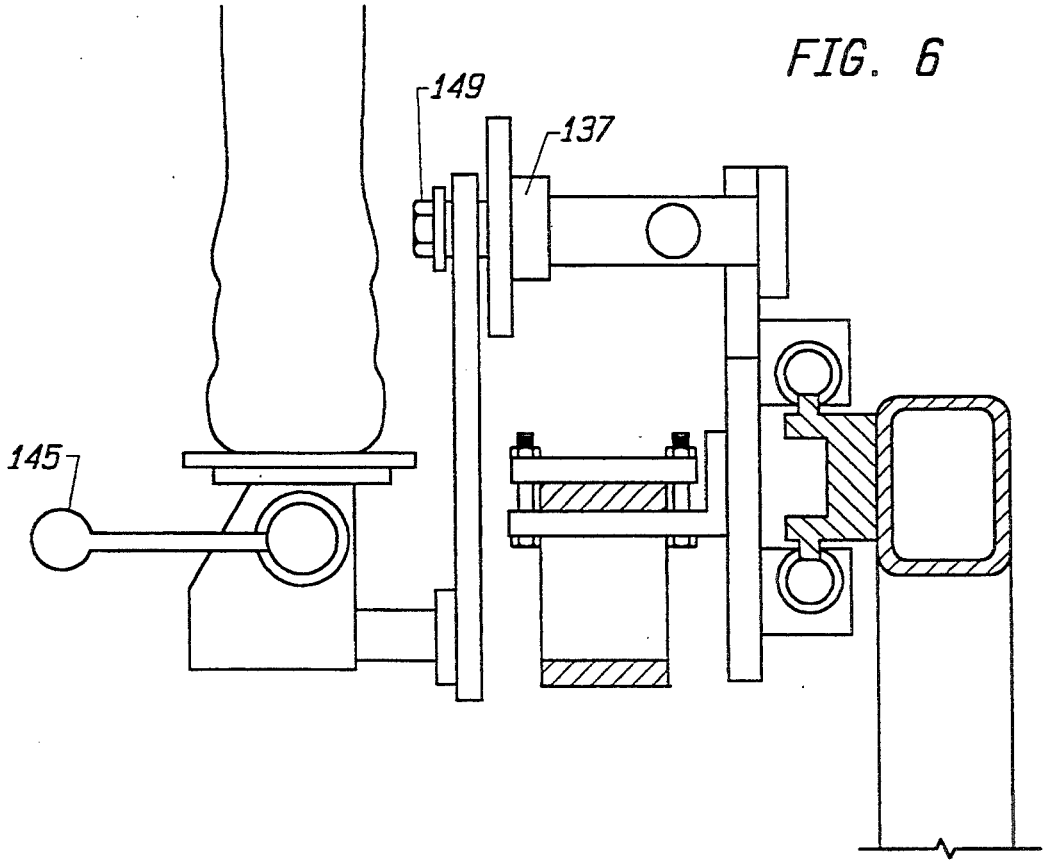
FIG. 6 is a rear view of the peddle assembly shown in FIG. 4.

FIGS. 5 and 6 are perspective and rear views, respectively, of pedal assembly 40 for use with the embodiment of apparatus 20 shown in FIG. 1. As shown therein, pedal assembly 40 is coupled to a force transducer 150 mounted directly by plate 142 to slide 50. Force transducer 150 may comprise a 2-axis force transducer resolving forces on 2 axes—defined for reference herein as the x and y axis—forming the plane of leg movement (the sagittal plane). Alternatively, transducer 150 provides 3-axis measurement of torque incident upon pedal plate 140 by a foot positioned therein, including the x and y linear axes and a rotational component about the axis "c" defined by the length of bolt 149. Such a 3-axis torque transducer 150 is available at Tri-Costal Industries, Mukilteo, Wash. Vertical mounting plate 144 is bolted by belt 149 via a bushing 137 into a cavity 151 (FIG. 10) of torque transducer 150.

As shown in FIG. 6, a handle 145 allows for vertical adjustment of plate 140 so that the rotational axis of the ankle aligns with axis "c." Pedal plate 140 includes a heel support 146 and a toe strap 148 for securing the foot of the test subject therein. Heel support 146 is adjustable by means of the handle 147 to accommodate different foot sizes. In one embodiment, the rotational position of pedal 140 about axis "c" is fixed. In an alternative embodiment, pedal 140 may be rotated in a direction of Arrow "B" as shown in FIG. 5 as a leg of an individual is extended and retracted as shown in FIGS. 7 and 8. As discussed below, the force components supplied by torque transducer 150 are utilized to compute the force—both torque and linear—incident upon each joint of the leg, including the ankle joint, knee joint, and hip joint.

As shown in FIG. 7, an individual may utilize the device in the seated position with a vertically oriented back, or as shown in FIG. 8, the individuals back may be horizontally oriented in the reclined position during use of the device. FIGS. 7 and 8 also illustrate how the rotational movement of pedal plate 140 may accommodate flexion and extension of the leg.

Figure 9:
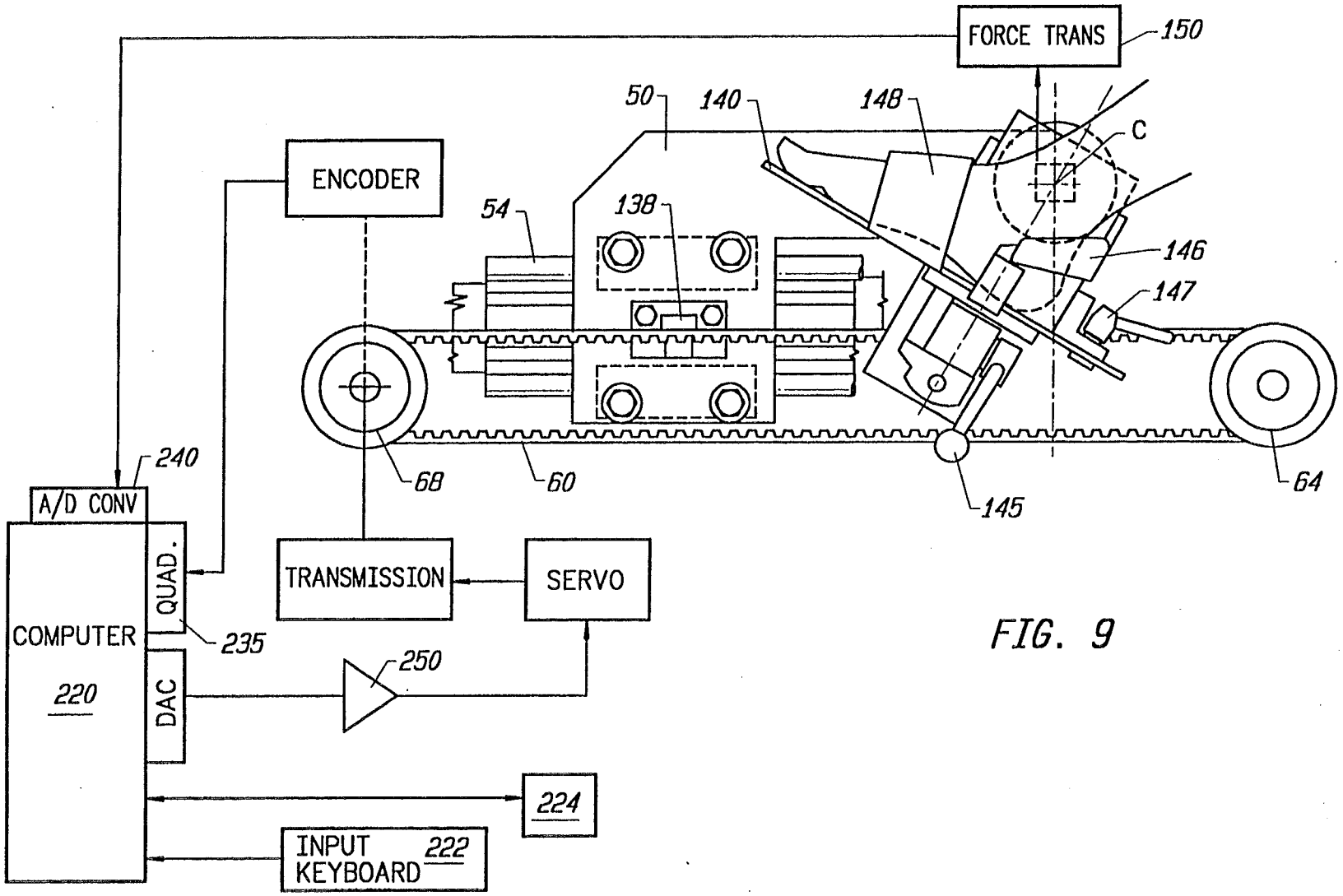
FIG. 9 is a block diagram of the hardware portion of the control system used in conjunction with the exercise system of the present invention.

In order to implement the various control modes with the mechanics shown in FIGS. 1–6, a control system as shown in FIG. 9 may be utilized. A computer 220, such as an IBM personal computer or equivalent using a Intel 80486 or superior microprocessor is utilized to interpret control software for the system. Computer 220 may include any number of expansion boards such as digital analog converter and amplifier interface 230, optical encoder input board 235, and analog-to-digital converter 240. As shown in FIG. 9, the outputs of optical encoders 200,210 are input to a quadrature receiver interface board 235 provided in an expansion slot in computer 220. This allows the outputs of optical encoders 200,210 to be multiplied by a factor of 4 to increase resolution of the position data along the extension and retraction path of the patient's leg. Also included is a digital-to-analog converter interface 230 which couples output instructions from computer 220 to power amplifiers 245,250 which, in turn, provide controlled output voltage to servo motors 80,82 to vary speed and torque of the motors as needed. A user interface for computer 220 may include an input means such as a keyboard 222 and/or a display/touch screen interface 224.

In alternative embodiments, a seat activated sensor may be coupled to the computer to initiate automated process sequences, as will be generally understood, to compute the forces present at each joint, limb segment lengths must be utilized. Such data may be manually input or a semi-automatic ((user assisted) electronic limb measuring device may also be included as a direct input to computer 220.

Control software stored in a nonvolatile storage medium in computer 220 may be run by computer 220 to compute the forces present on each particular joint and segment of the limb under evaluation based on data input from both the load cell 150 optical encoders 200,210 and user specific data such as limb size and weight. This computed data can be output to a display 224 and used in servo loops to control the application of force and velocity to pedal assemblies 40,42 by the servo motors during various modes.

Figure 10:
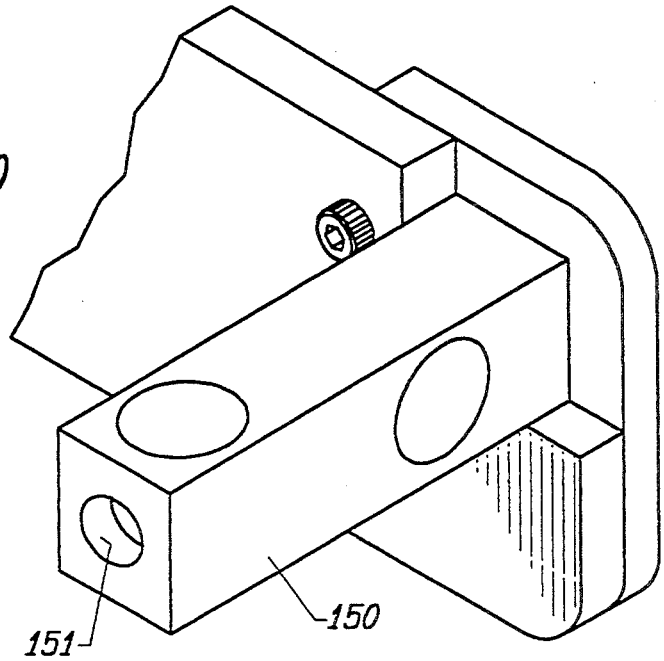
FIG. 10 is a perspective view of the force transducer utilized to couple the movements of a particular limb to the control system of the present invention.

A biomechanical model utilized as the basis for such calculations is shown in FIG. 10. As used herein, point A indicates the rotational axis of the ankle; point K, the rotational axis of the knee, and point H the rotational axis of the hip. The letters "X," "Y" and "Z" denote the axes of the inertial coordinate system, with the X-Y axis forming the sagittal plane, and the Z axis being mutually perpendicular to X and Y. The letters "x," "y" and "z" denote axis of the local pedal coordinate systems with positive x directed towards the front of the pedal and along the pedal platform, positive y directed toward the pedal platform and z mutually perpendicular to x and y. $L_s$ and $L_t$ indicate the length of the shank and thigh segments, respectively. CG indicates the center of gravity of the respective segments.

Figure 11:
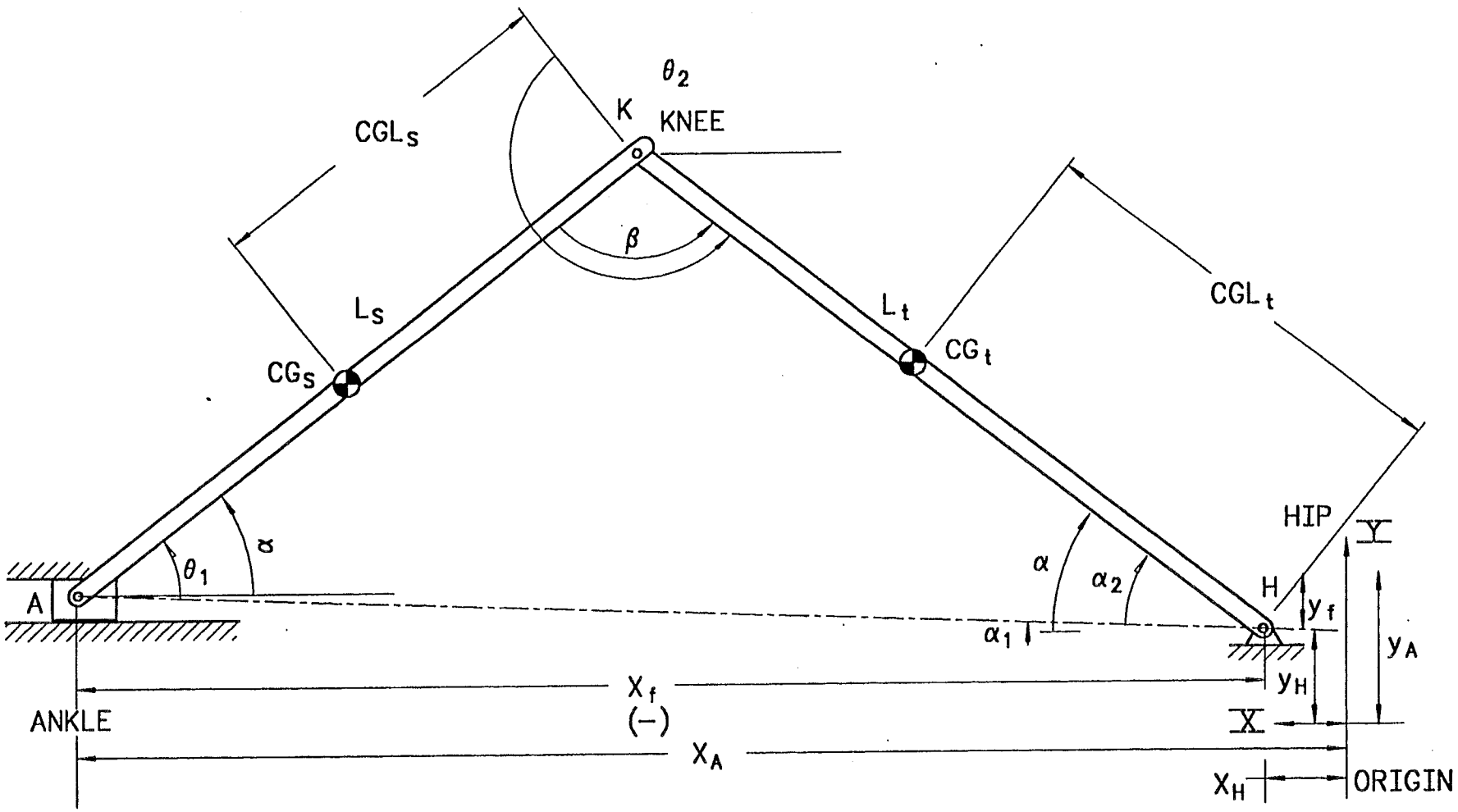
FIG. 11 is a graphic representation of a biomechanical model utilized by the software of the present invention to compute forces at various limb joints.

The biomechanical model of FIG. 11 shows a medial view of the right leg which is used to calculate the various forces by the control software of the present invention. As noted above, various segment lengths including $L_s$, and $L_t$, must be determined and input to the control software to calculate the respective forces. In addition, the height $Y_H$ of an individual's hip joint rotational axis H must be determined in relation to the X-Y origin at the seat base.

Figure 12:
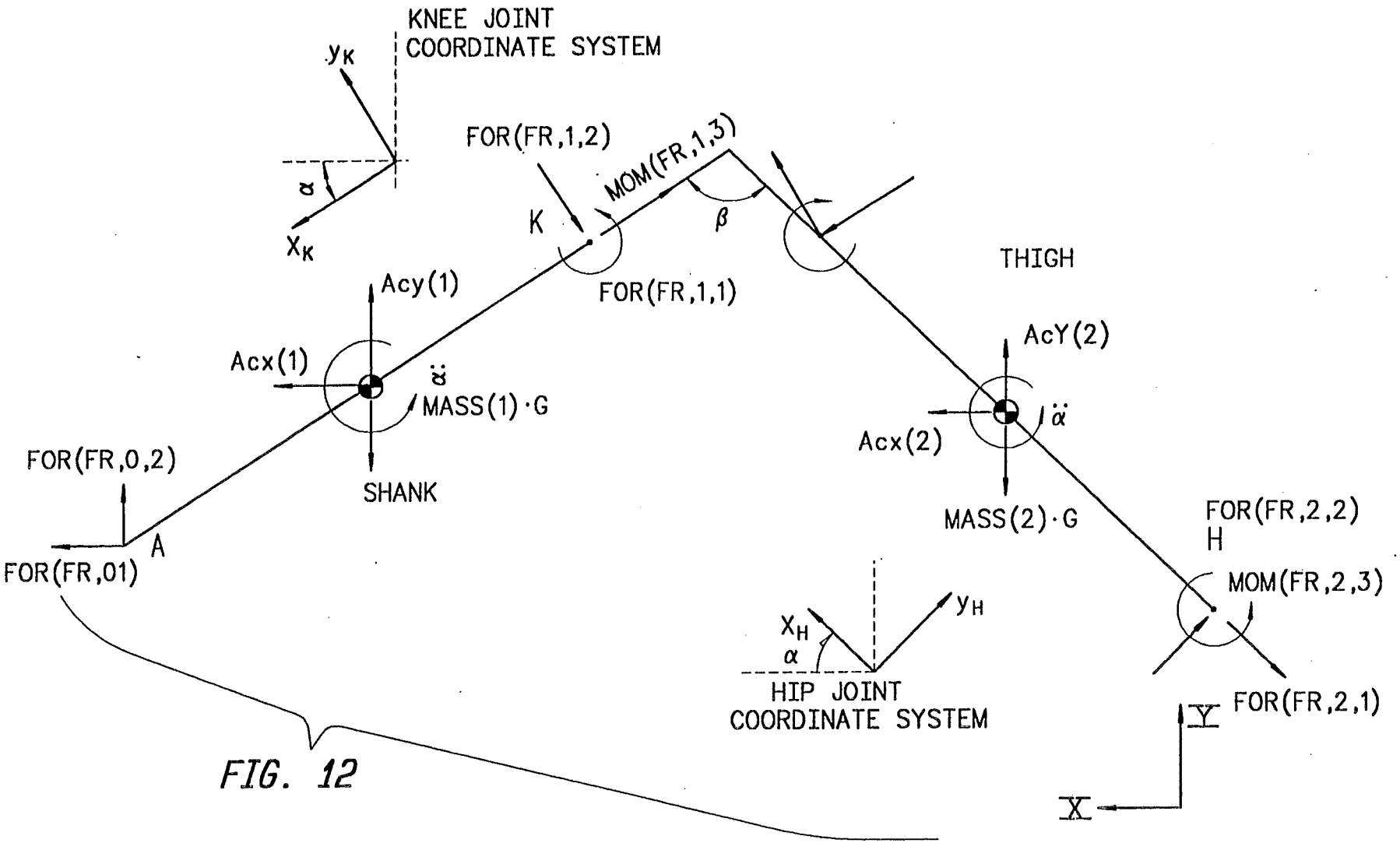
FIG. 12 is a graphic representation of the forces incident upon the leg of a test subject which is computed by the control software of the present invention.

FIG. 12 is a graphic representation of the forces computed by the control software. As will be understood by one skilled in the art, the control software samples the data input from optical encoders 200,210 and load sensor 150, over a number of data points, thereby allowing resolution of speed based on a calculation of position in relation to time. In fact, four separate counters may be utilized, as set forth below, to gather data over a series of data points for the required calculations. The variables and abbreviations used in FIG. 12 are defined as follows:

NFS=Total number of frames or data points
FR=A counter ranging from 1 to NFS
SEG=A counter where:
0—Load Transducer/Ankle
1—Shank or Knee
2—Thigh or Hip
DIR=A counter where:
1—X Direction (Local or Inertial)
2—Y Direction
3—Z Direction (Out of Paper Positive)
KIN=A counter where:
1—Position Data
2—Velocity Data
3—Acceleration Data
TRANG=Angle between similar axes of different local coordinate frames The theoretical model utilizes a scheme wherein the measured forces incident upon the load sensor 150, pedal/ankle forces, are transposed to the knee joint coordinate system and the thigh coordinate system. As noted above, four software counters (FR, SEG, DIR, KIN) are constantly running during sampling of the data from the optical encoders and the load sensor. For an accurate determination of loads, both a quasi-static and a dynamic component of force are computed and summed. It should be noted that the dynamic component of the load is significantly smaller than the quasi-static component, and because two derivatives must be taken to determine the acceleration component, additional processor time is required. In one embodiment, only the quasi-static loads are used to provide a data output for both control and user use. Such embodiment, provides more rapid feedback and control, both to the user and the control system loops, since calculation time is markedly reduced. In an alternative embodiment, the dynamic component of the force is computed and summed with the quasi-static load to provide a total force. Such embodiment provides a more accurate force/load calculation.

With respect to FIG. 12, the following definitions apply:

$\ddot{\alpha}(t)$=Angular acceleration of thigh, positive counterclockwise $\ddot{\gamma}(t)$=Angular acceleration of shank, positive counterclockwise FOR(FR,SEG,DIR)=Joint forces in distal segment reference frame QFOR(FR,SEG,DIR)=Quasi-static component of joint forces DFOR(FR,SEG,DIR)=Dynamic component of joint forces MOM(FR,SEG,DIR$^3$)=Joint moments about distal segment coordinate axes QMOM(FR,SEG,DIR$^3$)=Quasi-static component of joint moment QMOM(FR,SEG,DIR$^3$)=Dynamic component of joint moment MASS(SEG)=Segment mass in kg G=Acceleration of gravity $AC_x$(FR,SEG)=Segment C of G acceleration in inertial "x" direction $AC_y$(FR,SEG)=Segment C of G acceleration in inertial "y" direction INERT(SEG)=Segment moment of inertia in sagittal plane about proximal end (flex/extend)

Figure 13:
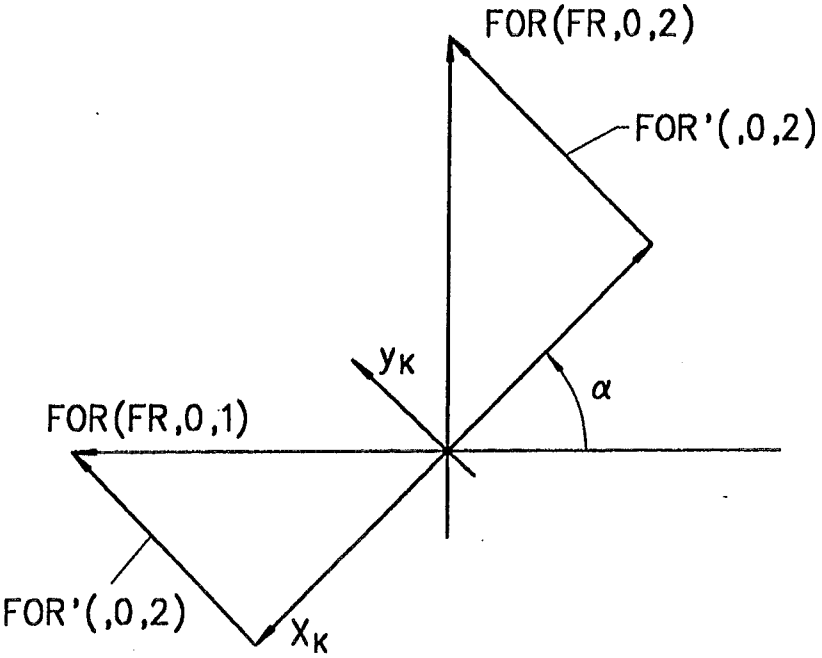
FIG. 13 is a depiction of the local knee joint coordinate system utilized in calculating forces on limb segments.

FIG. 13 is a depiction of the knee joint coordinate system utilized in calculating forces on each limb segment. The pedal/ankle forces are transposed to the knee joint coordinate system. Because of an equal and opposite reaction by the ankle on the force transducer, forces have opposite signs to those of the transducer output. Variable TANG in equations (1) and (2) is equal to the angle $\gamma$ shown in FIG. 13. For the knee joint coordinate system, the transposed forces are as follows:

(1) FOR'(FR,0,1)=FOR(,0,1) COS (TANG)−FOR(,O,2) SIN (TANG)

(2) FOR'(FR,O,2)=FOR(,0,1) SIN (TANG)+FOR(,0,2) COS (TANG)

In computing the quasi-static load at the knee, it is assumed that the sum of all forces are equal to zero ($\Sigma F=0$), and the sum of the segment masses are equal to zero ($\Sigma M=0$). For such assumptions, the quasi-static component of the load at the knee is computed as follows:

(3) QFOR(FR,1,1)=−FOR'(FR,0,1)+MASS(1).G.SIN $\gamma$ (4) QFOR(FR,1,2)=−FOR'(FR,0,2)+MASS(1).G.COS$\gamma$ (5) QMOM(FR,1,3)=−FOR'(FR,0,2).$L_s$−MASS(1).G.COS$\gamma$.($CGL_s$)

The dynamic load is computed using the following equations where the sum of the forces is equal to mass times acceleration ($\Sigma F=MA$) and the sum of the mass is equal to the moment of inertia multiplied by the angular velocity ($\Sigma M=I\alpha$):

(6) DFOR(FR,1,1)=MASS(1)[$AC_x$(1) COS $\gamma$−$AC_y$(1) SIN $\gamma$]

(7) DFOR(FR,1,2)=MASS(1)[$AC_x$(1) SIN $\gamma$+$AC_y$ COS $\gamma$]

(8) DMOM(FR,1,3)=−MASS.$CGL_s$[$AC_x$(1) SIN $\gamma$+$AC_y$(1) COS $\gamma$]+INERT(1).$\ddot{\gamma}$ The total result of loads are therefore as follows:

(9) X: FOR (FR,1,1)=−FOR'(FR,0,1)−MASS(1)[(G+$AC_y$ SIN $\gamma$−$AC_x$(1) COS $\gamma$]

(10) Y: FOR (FR,1,2)=−FOR'(FR,0,2)−MASS(1)[($AC_y$+G) COS $\gamma$+$AC_x$(1) SIN$\gamma$]

Figure 14:
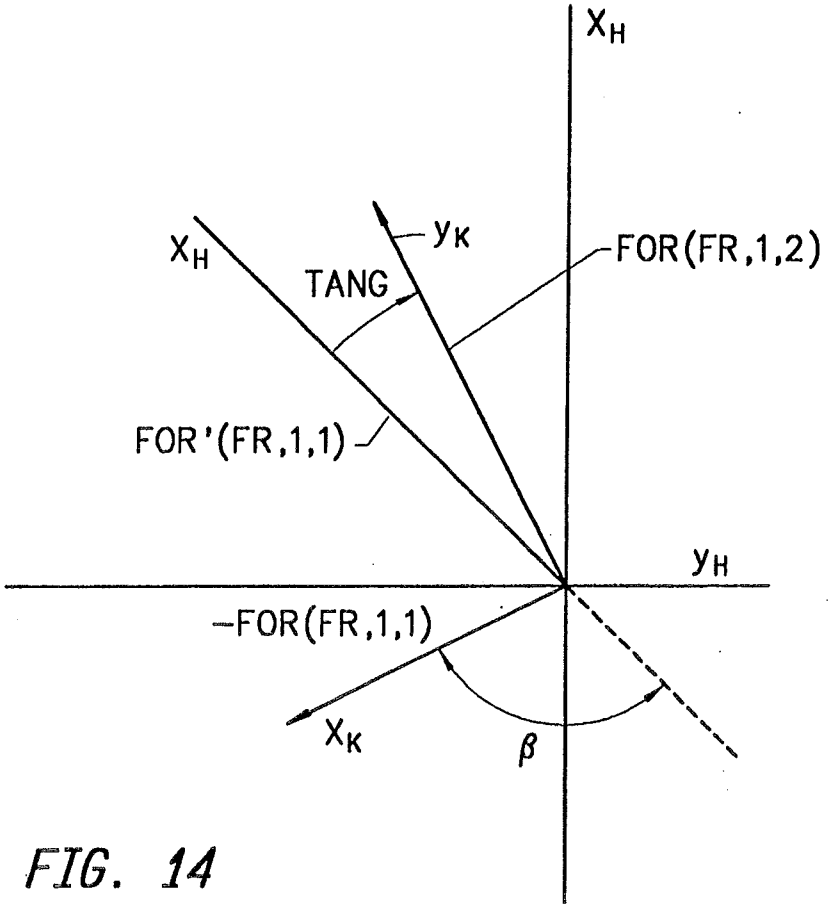
FIG. 14 is a depiction of the local hip joint coordinate system utilized in calculating forces on limb segments.

(11) Z: MOM(FR,1,3)=FOR'(FR,0,2).$L_s$−MASS(1)CG$L_s$[(G+$AC_y$(1)) COS $\gamma$+$AC_x$(1)SIN $\gamma$]+INERT(1).$\ddot{\gamma}$ In computing the forces incident on the thigh of an individual's leg, variable TANG is equal to angle $\beta-90$. FIG. 14 shows the local coordinate system utilized to model the hip region. Using the local coordinate system shown in FIG. 14, the transposed loads are as follows:

(12) FOR'(FR,1,1)=−FOR(FR,1,1) SIN (TANG)−FOR(FR,1,2) COS (TANG)

(13) FOR'(FR,1,2)=−FOR(FR,1,1) COS (TANG)−FOR(FR,1,2) SIN (TANG)

The quasi-static loads are as follows:

(14) QFOR(FR,2,1)=−FOR'(FR,1,1)+MASS(2).G.SIN $\gamma$

(15) QFOR(FR,2,2)=−FOR'(FR,1,2)+MASS(2).G. COS $\gamma$

(16) QMOM(FR,2,3)=+MOM(FR,1,3)+FOR'(FR,1,3)$L_t$−MASS(2)G.CG$L_t$.COS $\alpha$

The dynamic loads are as follows:

(17) DFOR(FR,2,1)=MASS(2)[$AC_x$(2) COS $\alpha$+$AC_y$(2) SIN $\alpha$]

(18) DFOR(FR,2,2)=MASS(2)[−$AC_x$(2) SIN $\alpha$+$AC_y$(2) COS $\alpha$]

(19) DMOM(FR,2,3)=MASS(2).CG$L_t$[$AC_x$(2) SIN $\alpha$−$AC_y$(2) COS $\alpha$]+INERT(2)$\ddot{\alpha}$ And the total hip loads, summing the quasi-static and dynamic components, are as follows:

(20) X: FOR(FR,2,1)=−FOR'(FR,1,1)+MASS(2)[$AC_x$(2) COS $\alpha$+($AC_y$(2)+G) SIN $\alpha$]

(21) Y: FOR(FR,2,2)=−FOR'(FR,1,2)+MASS(2)[($AC_y$(2)+G) COS $\alpha$−$AC_x$(2) COS $\alpha$]

(22) Z: MOM(FR,2,3)=+MOM(FR,1,3)+FOR'(FR,1,1)$L_t$−MASS(2).CG$L_t$.[(G+$AC_y$(2)) COS $\alpha$+$AC_x$(2) SIN $\alpha$]+INERT(2).$\ddot{\alpha}$ Using the aforesaid computed loads and forces, standard isokinetic programming loops, and isometric and isotonic software programming may be utilized in the control software of the present invention to control current to servo motors 80,82 and servo loops depending on the particular function desired of apparatus 20. Examples of such software loops are shown in co-pending application Ser. No. 07/789,834, entitled PHYSIOLOGICAL EVALUATION AND EXERCISE SYSTEM. Such application is hereby specifically incorporated by reference.

As noted from a review of the above, only forces FR(,0,1) and FR(,0,2) are measured for the above calculations. The above equations thus assume use of a fixed angle at the ankle joint and the third component of force—measurable when a three-axis force transducer 150 is used—is not accommodated in the above equations.

The many features and advantages of the present invention will be obvious to persons of average skill in the art. Such features and advantages are intended to be within the scope of this invention as defined in the instant specification and the following claims.

What is claimed is:

1. A closed chain apparatus for evaluation of a limb of a test subject, the limb having a proximal end and a distal end, the apparatus comprising:

means for securing the distal end of the limb to the apparatus and means for securing the proximal end of the limb to the apparatus;

means for applying a controlled load to the means for securing the distal end of the limb;

means for determining forces applied by the test subject on each joint of the limb while the controlled load is applied to the limb;

position sensing means for detecting the position of the means for securing the distal end of the limb; and force sensing means, coupled to the means for securing the distal end of the limb, for detecting the forces applied by the test subject to the means for securing by the limb, the force sensing means detects at least two components of force;

wherein the means for determining includes:

means for entering limb segment lengths, means for reading the force components of the force sensing means over a period of cycles, means for transposing the force components to a local coordinate system defined by a joint of interest, and means for computing a quasi-static component of the load at the local coordinate system defined by the joint of interest.

2. The apparatus of claim 1 wherein the means for determining computes the forces applied by the test subject in plane of movement, including the linear and rotational forces incident on the limb.

3. The apparatus of claim 1 wherein the force sensing means detects three components of force, two linear components and one rotational component.

4. The apparatus of 3 wherein the means for determining the force applied at each joint of the limb is coupled to the force sensing means, and the means for computing utilizes the three components of force to derive the forces incident at each joint of the limb.

5. The apparatus of claim 1 wherein the means for determining further includes:

means for computing a dynamic component of the load at the local coordinate system defined by the joint; and means for summing the quasi-static and dynamic load components to derive a total load at the joint.

6. A system for evaluating and training a leg including a hip joint, a knee joint, an ankle joint and a foot of a test subject, comprising:

movable means for securing the foot of the leg to the system;

means for supporting and securing the hip joint of the test subject in a fixed position;

means for supplying concentric or eccentric force to the means for securing; and means for determining the force applied to the knee joint, the ankle joint and the hip joint of the leg of the test subject during extension and retraction of the leg of the test subject comprising:

means for detecting the position of the means for securing, means for measuring the force applied to the means for securing by the foot of the test subject, control means, coupled to the means for supplying, for controlling the amount of force applied to the means for securing by the means for supplying, means for computing the force applied to each joint of the leg of the test subject, means for transposing the force components to a local coordinate system defined by an individual leg joint, and means for computing a quasi-static component of the load at the local coordinate system defined by the joint.

7. The system of claim 6 wherein the control means includes means for controlling force and velocity of the means for securing to provide isometric, isokinetic, or isotonic force control of the means for securing.

8. The system of claim 7 wherein the means for controlling utilizes the knee joint to control the force of the means for securing.

9. The system of claim 7 wherein the means for controlling utilizes the hip joint to control the force of the means for securing.

10. The system of claim 6 wherein the means for securing is arranged for linear movement with respect to the means for supporting and securing the hip, and the means for supplying concentric or eccentric force comprises a chain, coupled to the means for securing, a transmission assembly coupled to the chain, and at least one servo motor coupled to the gear assembly and the control means.

11. The system of claim 6 wherein the means for determining further includes:

means for computing a dynamic component of the load at the local coordinate system defined by the joint; and means for summing the quasi-static and dynamic load components to derive a total load at the joint.

12. The system of claim 6 wherein the means for securing comprises a foot pad having a passive restraint for securing a foot to the foot pad.

13. The system of claim 12 wherein the bottom of the foot is secured at a fixed position such that linear movement of the pad results in dorsiflexion and plantar flexion of the foot.

14. A system for evaluating and training the leg of a test subject, comprising:

means for securing the ankle and means for securing the hip of at least one leg of a test subject;

means, coupled to the means for securing the ankle, for providing a resistance on the means for securing the ankle;

means for measuring the force exerted on the means for securing the ankle by the leg of the test subject;

means, coupled to the means for providing and the means for measuring, for controlling the means for providing and measuring, and for calculating the force exerted on the ankle, knee and hip joints of the leg of test subject; and position sensinq means for determining the position of the means for securing the ankle relative to the means for means for securing the hip;

wherein the means for controlling and calculating comprises a computer having programming means for directing the operation of the computer, the programming means including means for providing isometric, isokinetic, isotonic, or static force on the means for securing, means for reading the position of the pedal from the position sensing means over a period of data points, means for reading the force components of the force sensing means over the period of data points, each read of the force components being relative to the position of the ankle, means for transposing the force components to a local coordinate system defined by the joint of interest, means for computing a quasi-static component of the load at the local coordinate system defined by the joint, means for computing a dynamic component of the load at the local coordinate system defined by the joint, and means for summing the quasi-static and dynamic load components to derive a total load at the joint.

15. The system of claim 14 wherein the means for securing the hip comprises a seat, having a passive restraint coupled thereto, and a backrest being adjustable to form a plurality of angles with respect to the seat.

16. The system of claim 14 wherein the means for providing resistance on the means for securing the ankle comprises a looped chain provided about first and second pulleys at first and second positions of the chain, the means for securing the ankle being coupled to the looped chain, a transmission assembly, coupled to the first gear element, and a servo motor, coupled to the transmission assembly.

17. The system of claim 14 wherein the means for securing the ankle comprises a foot pedal, having straps coupled thereto, the pedal being arranged for linear movement with respect to the means for securing the hip.

18. The system of claim 14 wherein the means for measuring the force exerted on the means for securing comprises a force sensor, having a first, second and third transducer, the first and second transducers providing first and second linear force components, the third transducer providing a rotational force component.

* * * * *